US009271616B2

(12) United States Patent
Yaros

(10) Patent No.: US 9,271,616 B2
(45) Date of Patent: Mar. 1, 2016

(54) MOIST TOWELETTE DISPENSING APPARATUS

(76) Inventor: Andrew Yaros, Solana Beach, CA (US)

( * ) Notice: Subject to any disclaimer, the term of this patent is extended or adjusted under 35 U.S.C. 154(b) by 88 days.

(21) Appl. No.: 13/358,354

(22) Filed: Jan. 25, 2012

(65) Prior Publication Data

US 2012/0118909 A1 May 17, 2012

Related U.S. Application Data

(63) Continuation-in-part of application No. 12/534,049, filed on Jul. 31, 2009, now Pat. No. 8,474,652.

(51) Int. Cl.
*A47K 10/42* (2006.01)
*A47K 10/38* (2006.01)
*A47K 10/32* (2006.01)

(52) U.S. Cl.
CPC ..... *A47K 10/38* (2013.01); *A47K 2010/3266* (2013.01); *A47K 2010/389* (2013.01)

(58) Field of Classification Search
USPC ..... 221/34, 94
See application file for complete search history.

(56) References Cited

U.S. PATENT DOCUMENTS

| | | | | |
|---|---|---|---|---|
| 8,777,053 | B2 * | 7/2014 | Bunoz | 221/45 |
| 2003/0075117 | A1 * | 4/2003 | Lin | 119/867 |
| 2003/0116582 | A1 * | 6/2003 | Tosdale | 221/70 |
| 2009/0200331 | A1 * | 8/2009 | Bunoz et al. | 221/46 |
| 2010/0032445 | A1 * | 2/2010 | Bunoz | 221/45 |

FOREIGN PATENT DOCUMENTS

| | | | | |
|---|---|---|---|---|
| GB | 2270299 A | * | 3/1994 | A47K 10/38 |

* cited by examiner

*Primary Examiner* — Gene Crawford
*Assistant Examiner* — Kelvin L Randall, Jr.
(74) *Attorney, Agent, or Firm* — Donn K. Harms

(57) ABSTRACT

A moist towelette dispenser device adapted for use in combination with a toilet paper holder assembly having an elongated cylindrical spindle with two ends engageable which mount on a conventional toilet paper fixture to support a roll of toilet paper. The device provides for concurrent dispensing of toilet paper and moist towelettes and an air freshener. A housing provides a dispensing site for the towelettes and is engageable to the room mount by two elongated members. The toilet paper is operatively mounted on the spindle engaged between the members.

12 Claims, 10 Drawing Sheets

MOIST TOWELETTE DISPENSING APPARATUS

This application is a Continuation in Part of U.S. application Ser. No. 12/534,049 filed on Jul. 31, 2009 now U.S. Pat. No. 8,474,652 and which is incorporated herein in its entirety by reference.

FIELD OF THE INVENTION

The device herein described and disclosed relates to personal hygiene and the employment of moist towelettes. More particularly it relates to a device adapted for engagement with a conventional toilet paper mount which has an enclosure adapted for engagement to a container of moist towelettes.

BACKGROUND OF THE INVENTION

Over the last decade, pre-moistened towelettes have become a widely employed means for personal hygiene. Such towelettes are conventionally pre-moistened with any of a plurality of liquids which clean and may have antibacterial properties. Other such towelettes may be pre-moistened with skin softeners or medications for employment by a user in daily hygiene or medication purposes. Conventionally, moist towelettes are sold in containers which maintain the moist nature of the towelettes and provide an easy means to dispense individual towelettes.

In addition, hand sanitizers have also become a predominantly employed means for personal hygiene and sanitation. Hand sanitizers are often employed as a supplement or alternative to washing hands with soap and water. Sanitizers are typically a gel, foam or liquid dispensed conventionally through a pump dispensing unit or squeeze bottle providing easy and convenient means to sanitize hands. Recently, producers of hand sanitizers have begun combining the sanitizing solution with natural products and essential oils to provide moisture and conditioning to the user's skin to satisfy the ever growing skin care industry.

Personal hygiene, while in a bathroom, has become an ever more favored means of employment of such towelettes and hand sanitizers. Such towelette and hand sanitizers dispensers provide easy access of hygiene products to users in a bathroom while standing in front of the sink or bathroom counter on which the towelette container is supported. However, with bathroom counter top space becoming ever more crowded, it frequently becomes a choice of which hygiene appliance and which personal hygiene product is given counter space at the expense of other favored products.

Additionally, the toilet in modern bathrooms is frequently in a smaller room housed in the bathroom yet separated from the main area by a door and wall surrounding it. In such small areas, there is frequently no counter space provided at all because of the limited use of the room for its short term occupant. However, it is becoming more and more popular to employ towelettes as well as hand sanitizers solutions, in place of or along with toilet paper, in personal hygiene after using the toilet. This is especially true where the application of medications or moisturizers is required or desired to treat or comfort skin or other problems which may be causing discomfort for users of the toilet.

However, due to the limited space in the small area, and due to the proclivity of other users of a bathroom to remove additional hygiene products from the counter top, it becomes a vexing problem to provide such towelettes and hand sanitizers in a location proximate to the user of the toilet. This is especially true where multiple people may use the same toilet, but not all wish to use, or need, the towelettes or sanitizers subsequent to finishing up their stay on the toilet.

As such, there exists an unmet need for a container, or a mount for a container, that is positioned adjacent to a roll of toilet paper. Such a device should accommodate the needs of users of towelettes and hand sanitizers, yet not displace the roll of toilet paper that others may use or which may be employed in combination with towelettes.

Further, such a device should provide a means for engagement of a plurality of different types of towelettes for easy dispensing within arms reach of a toilet user.

Still further, such a device should provide means for engagement of other paper product rolls such as paper towels.

With respect to the above, before explaining at least one preferred embodiment of the towelette dispensing invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein, are for the purpose of description, and should not be regarded as limiting in any manner.

As such, those skilled in the art will appreciate that the concept upon which this disclosure is based may readily be utilized as a basis for designing of other devices for the dispensing of towelettes concurrently and proximate to the dispensing of toilet paper. It is important, therefore, that the objects of this invention, and claims herein, be regarded as including any such equivalent construction and methodology as would occur to those skilled in the art insofar as they do not depart from the spirit and scope of the present invention.

SUMMARY OF THE INVENTION

The device as herein disclosed and described provides a housing adapted to either contain a supply of towelettes internally, or to provide a means to engage a container of towelettes internally. In this fashion, the housing can operate as its own dispenser of sequentially dispensed towelettes, or can have an internal cavity adapted to engage with a container of towelettes to provide easy means to restock, or change the nature of the dispensed towelettes.

The housing of the device may further be adapted to contain a supply of hand sanitizers solution within a sealed portion of the housing, or to provide a means to engage a conventional pump dispenser.

The device features a novel means to engage the conventional projecting or recessed holes for a toilet paper roll mount. Such mounts conventionally employ a member that is telescopic in nature and biased toward its distal ends by an internal spring. This urges the distal ends of the member away from the center of the member and into a firm engagement with the recesses of the projecting or recessed mount. In spite of lacking adequate counter space, virtually every bathroom in the modern world employs some mode of this member and mount system to hold rolls of toilet tissue for use in the bathroom. Because of the precarious position such tissue users occupy during use of the toilet tissue, such dispensers must be within easy reach of the user at all times while in such a position.

The device herein allows for the concurrent positioning for the use of one or a combination of personal paper products, from a group including toilet tissue or paper towels, moist towelettes, and for use and dispensing of toiletries including for instance one or a combination of toiletries and medicinal products including liquid, gas or powder, hand sanitizers, skin creams, ointments, prescription solutions, cosmetic creams, and other dry and liquid products adapted for a flowing dispensing. Such dispensing is enhanced herein through the positioning of a means for dispensing such products within easy reach of a user, during a finishing up of hygienic matters proximate to the toilet or while going about a final act of personal hygiene.

However if employed for a dispensing of paper towels, while the device is adapted for employment for the maintenance of the bathroom areas, for such towel dispensing, the device is also adapted well for a positioning within a kitchen or similar area.

When employed in the bathroom, the device accomplishes this by employing a pair of projecting opposing planar members, which have projecting exterior portions adapted to engage within the recessed holes of the mount for the telescopic biased member. On the opposite side of the projecting planar members are a pair of opposing recesses adapted to engage the biased telescopic member which supports the toilet paper roll. The space between the planar members is adapted to allow the toilet paper roll to spin on the axis provided by the telescopic member and thereby dispense sheets of paper to the user. A novel guide slot provides a means to direct the paper forward of the housing when a user pulls on the distal end of the roll which may be advanced through the guide slot.

In yet another mode of invention the opposing recesses may alternatively be projecting protrusions intended to engage a toilet paper or paper towel roll directly without the necessity of the telescoping member. The protrusions will similarly allow the toilet paper roll to spin on an axis provided by the protrusions.

On the opposite end of the planar members, from the opposing recesses for the telescopic member, is located a cavity which is adapted for engagement with one or both of, a supply of moist towelettes housed in the cavity, or, a container holding a supply of such towelettes.

In an especially favored mode of the device, the diameter of the cavity would be such that it would frictionally engage the exterior of a container of towelettes. This would allow for the easy replacement of the supply when used, or when a different moistening agent is desired for medication or hygiene purposes.

Still optionally located on the opposite end of the planar members and preferably opposite the towelette dispensing side of the cavity, is a reservoir for receiving hand sanitizer solution. This reservoir preferably includes a cap providing sealed engagement and having a conventional pump style dispenser for dispensing sanitizer solution from within the reservoir. However, in an alternative mode, this portion of the device may include means for removable engagement of an existing conventional hand sanitizer pump. Such means for removable engagement may be a biasing clip or other means for removable engagement known in the art for biasing engaging the pump such as via biased frictional engagement of the exterior of the pump.

In use, the person finishing up from employment of the toilet, or within a kitchen, has the option of using one or a combination of the toilet paper, paper towels, towelettes, or the hand sanitizer for their hygiene purposes. This unique combination is provided within easy reach of the user in their frequently precarious position during such a use, and without the need for any counter space in the room hosting the toilet, thereby allowing for wide use of the device.

It is thus an object of this invention to provide a conventional housing for moist towelettes and hand sanitizer solution within easy reach of user leaving a stay on the toilet.

It is a further object of this invention to provide such a towelette and hand sanitizer dispenser which requires no counter space and will engage with virtually any conventionally employed toilet paper housing.

It is still a further object of this invention to provide such a towelette and hand sanitizer dispenser which additionally dispenses paper towels.

With respect to the above description and background, as noted earlier, before explaining at least one preferred embodiment of the invention in detail, it is to be understood that the invention is not limited in its application to the details of construction and to the arrangement of the components set forth in the following detailed description or illustrated in the drawings. The various apparatus of the invention herein described and disclosed are capable of other embodiments and of being practiced and carried out in various ways which will be obvious to those skilled in the art once they review this disclosure.

As such, those skilled in the art will appreciate that the conception upon which this disclosure is based may readily be utilized as a basis for designing of other devices for engagement with toilet tissue dispensers and concurrent dispensing of tissue and towelettes therefrom. It is important, therefore, that the objects and claims be regarded as including such equivalent construction and methodology, insofar as they do not depart from the spirit and scope of the present invention.

DETAILED DESCRIPTION OF PREFERRED EMBODIMENTS

Figure 1:
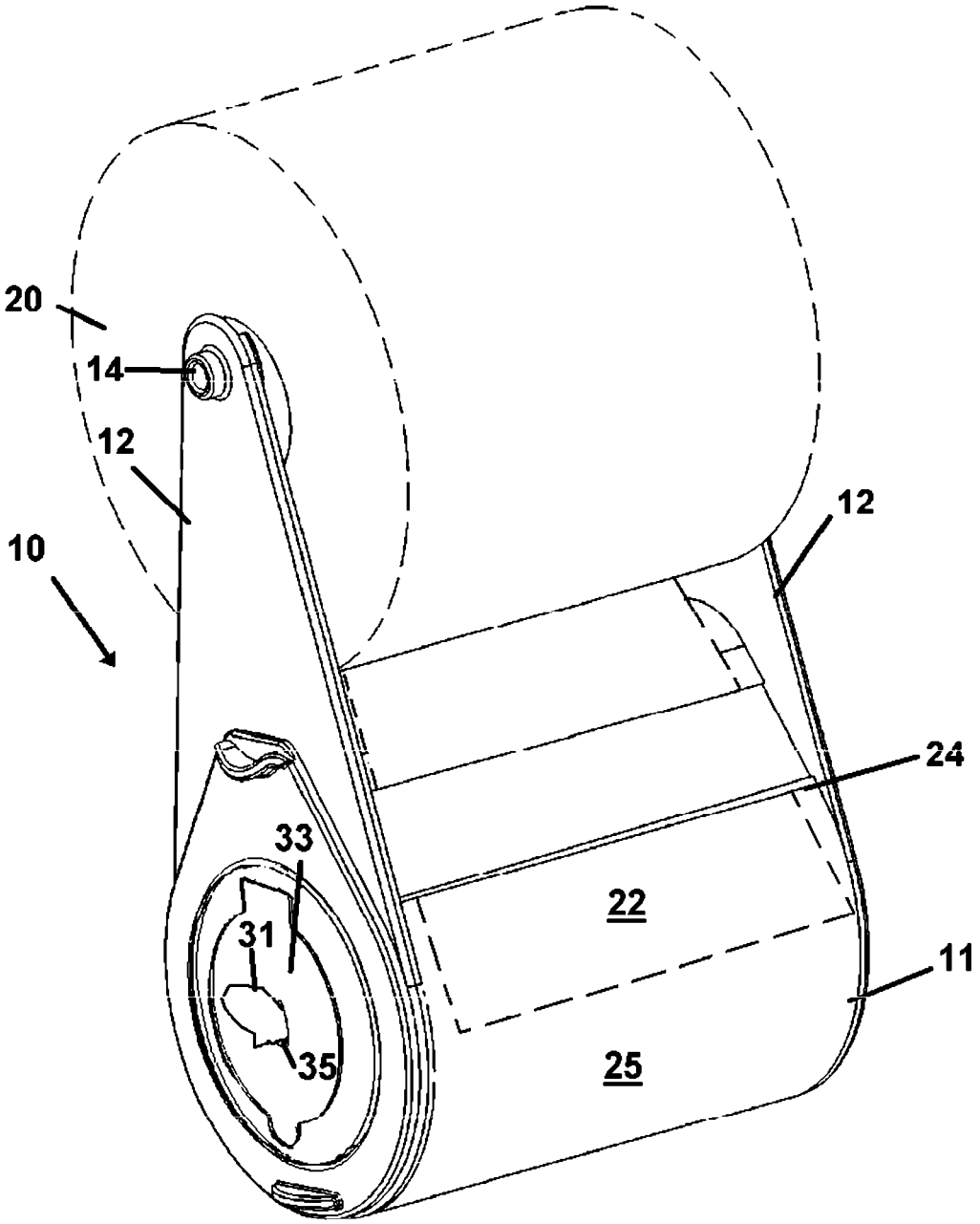
FIG. 1 depicts a perspective view of the device in the as-used position, showing planar members and projections therefrom adapted to engage the conventional recesses used in a toilet paper mount.
Figure 2:
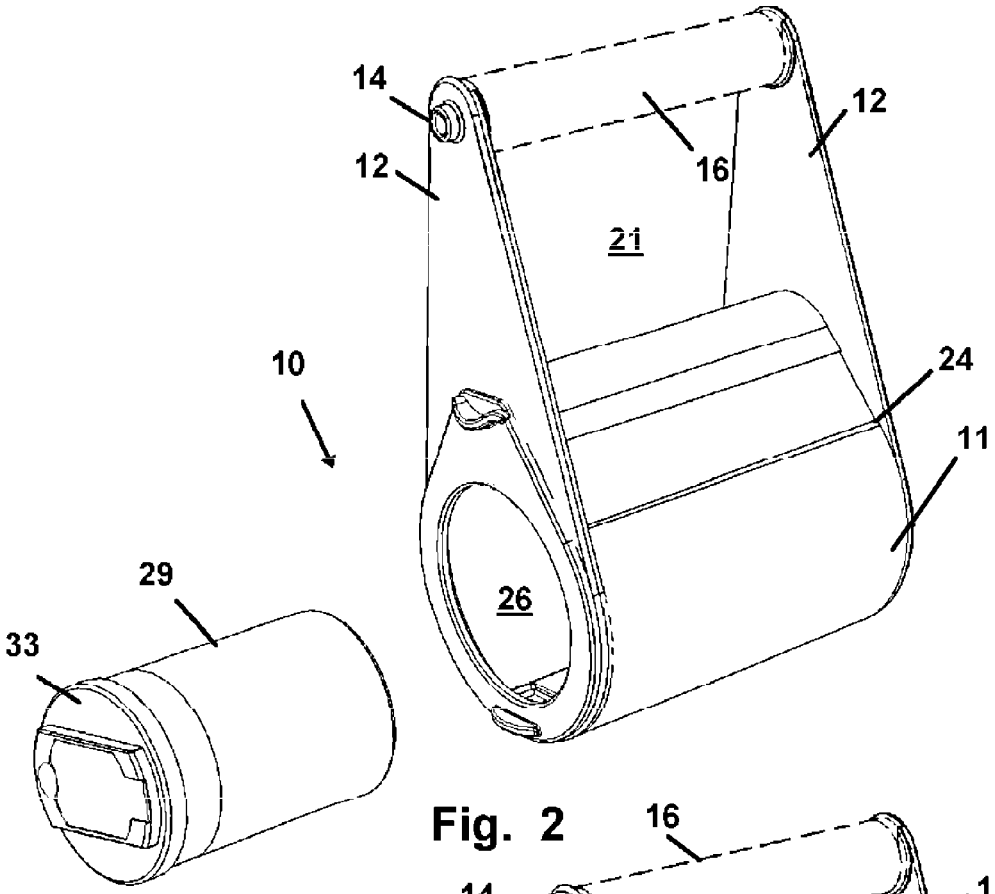
FIG. 2 is a perspective frontal view of the device showing the conventional toilet paper telescopic member engaged within the members and a frictionally engageable moist wipe container.
Figure 3:
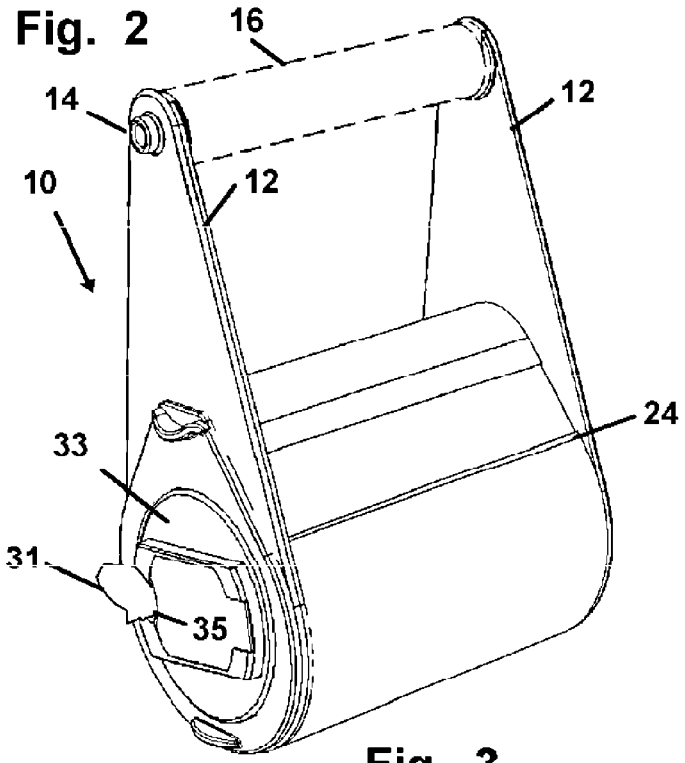
FIG. 3 is a perspective view of the device of FIG. 2 depicting the wipe container engaged within a cavity of a housing.

Referring now to FIGS. 1-10, as noted FIGS. 1-3 depict a perspective view of the device 10 which provides a housing 11 at first ends of a pair of opposing planar members 12. At the opposite end of the planar members 12 is provided a means to engage the device 10 with a conventional projecting or recessed mount, provided on a wall or surface in bathrooms of most homes and businesses. The conventional mount (not shown but well known) is provided for replaceable engagement with a conventional telescopic member 16 which is employed to support a toilet paper roll 20 in position for use wherein the paper wound on the roll 20 is pulled to dispense it causing the roll 20 to rotate on the telescopic member 16.

The depicted means to engage the device 10 with the noted conventional mount for the member 16, employs the pair of projecting opposing planar members 12, each of which have opposing exterior projections 14, positioned on the members 12 in a manner adapted to engage the recessed holes of the conventional mount which normally engages the biased telescopic member 16.

The planar members 12 are formed of resilient material having a memory for position. Consequently, the distal ends of the planar members 12 may be moved toward each other to allow engagement of the projections 14 with the mount at a home or business and will naturally bias away from each other and into the recesses of the conventional mount.

Figure 6:
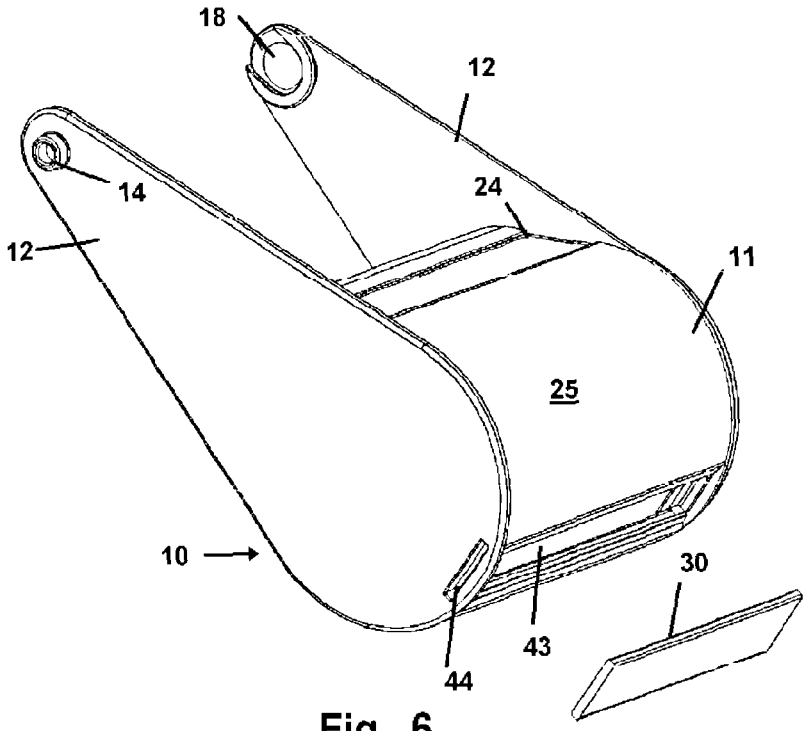
FIG. 6 shows a bottom perspective view of the device and the air freshener adapted for engagement to a mount with the exterior of the housing bottom.

As can be seen in FIG. 6, on the opposite side of the distal ends of the projecting planar members 12 from the projections 14 are positioned opposing recesses 18. These recesses 18 are adapted to engage the biased telescopic member 16, which exists already in most bathrooms having the wall or surface mount to support the toilet paper roll 20 adjacent to the toilet.

Figure 4:
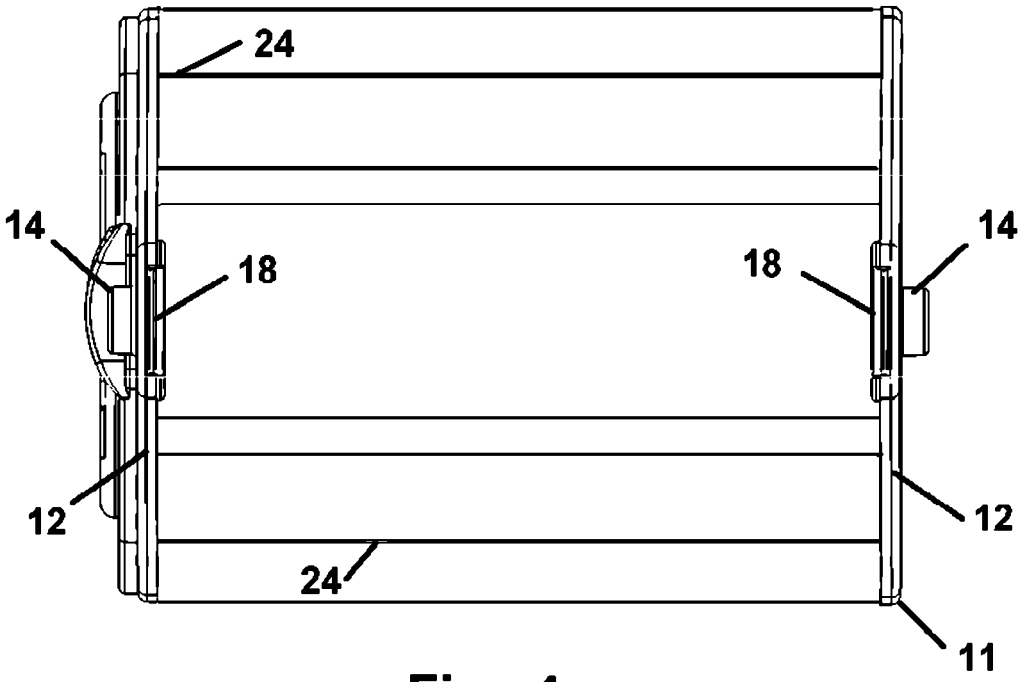
FIG. 4 is a top plan view of the device showing the projections positioned for engagement with a conventional toilet paper holder and races on both sides of the housing adapted to guide sheets of paper therethrough.
Figure 5:
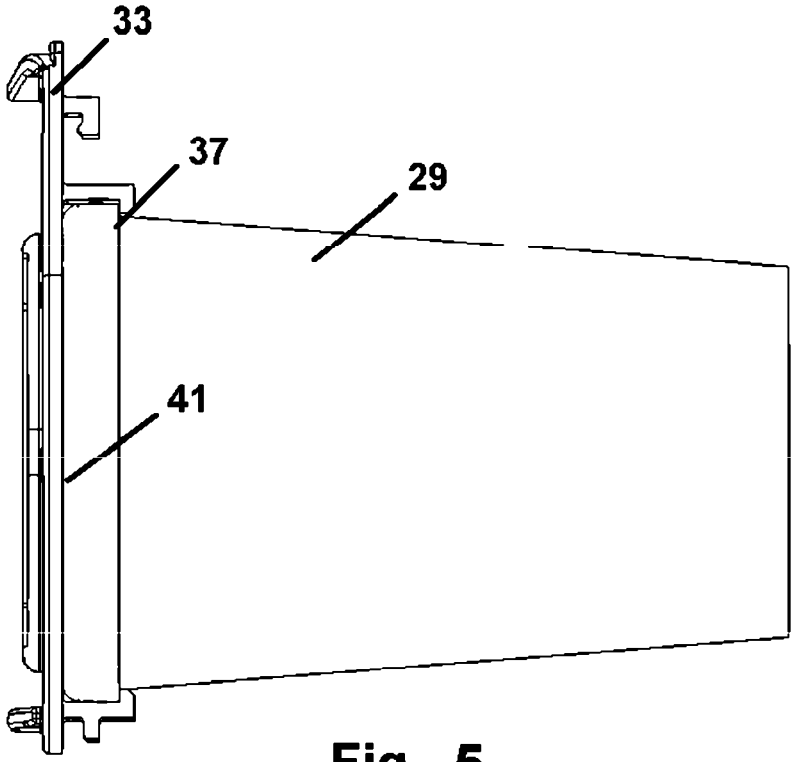
FIG. 5 depicts another mode of the wipe container adapted to engage with a cover for the housing cavity and for axial positioning with the cavity held horizontal by the cover engagement.

A gap 21 is defined by the area between the planar members 12 and is adapted to allow the toilet paper roll 20 to spin on the axis provided by the telescopic member 16 when engaged in the recesses 18 and thereby dispense sheets of paper from a distal end 22 of the roll 20. As can be seen in FIG. 1-3 and in FIG. 4, while not required, for a cleaner installation and means to keep the distal end 22 of the roll 20 from becoming hidden behind the roll 20 or housing 11, guide slots 24 are provided as a means to direct the distal end 22 of the paper during use. Placement of the guide slots 24 on both sides of the housing 11 as shown in FIG. 4, allow for their use in either a right handed or left handed paper mount adjacent to a toilet, which depends upon which side of the toilet the conventional toilet tissue mount for the existing member 16 is placed.

On the opposite end of the planar members 12 from the engaged telescopic member 16, formed within the sidewall 25 of the housing 11, a cavity 26 is provided which is adapted for engagement with one or both of, a supply of moist towelettes which may be placed and housed in the cavity 26, or, the exterior of a conventional retail container 29 which holds a supply of such towelettes 31. When the device 10 is engaged with the mount in a bathroom in the as-used position of FIG. 1, the towelettes 31 will project slightly from the cover 33 thereby positioning of the towelette 31 supply within the cavity 26, and immediately adjacent and easily reachable by a user. As shown, the towelettes 31 project from a cover 33 which would either engage the housing 11 or a container 29 depending on whether the towelettes 31 are provided in the container 29 or as a dispensable stack housed in the cavity 26.

Of course those skilled in the art will no doubt realize that other configurations may be employed to provide a dispensable supply of towelettes 31 from such a device 10 and any such mode of dispensing towelettes 31 from a housing 11 adapted to engage both a toilet paper mount and a support for a toilet paper roll 20 are anticipated to be within the scope of this application.

If the device 10 is configured to use the cavity 26 to house a supply of towelettes 31, the cavity 26 would feature an engageable removable cover 33 through which individual towelettes 31 would dispense sequentially from the housed supply. Alternatively, the cover 33 could provide access to the cavity 26 for insertion of a towelette 31 supply which would be dispensed through a wall of the device 10 and a cover 33 would seal the cavity 26 to sufficiently maintain the towelettes 31 in their moist state until dispensed.

If the device 10 is adapted for employment of conventional retail containers 29 housing the towelettes 31, the cavity 26 would have a diameter adapted to accommodate the exterior of the towelette container 29, and will be sufficiently long axially, to allow insertion of the container 29 into the cavity 26.

Should the cavity 26 be adapted to accommodate conventionally sold containers 29 of towelettes 31, such as those in grocery stores, a frictional or other removable means for operative engagement between the cavity 26, and the conventional container 29 would be provided. Such an engagement would be adapted to provide a means to hold the container 29 in a removable and replaceable engagement for use, and to place the dispensing aperture 35 for dispensing towelettes 31 at a side surface of the device 10. Further, such an engagement would provide for easy replacement of the container 29 such as a frictional engagement with the exterior surface of the container 29.

Alternatively, the device 10 may be provided in a manner adapted to engage the container 29 using the cover 33 which would be adapted to both hold the container 29 axially disposed in the cavity 26 and allow for easy removal and replacement. The cover 33 would have means for engagement to the exterior of the device 10 adjacent to the housing 11 defining the cavity 26 within. A first end 37 of the container 29 would be adapted for removable engagement with an interior surface 41 of the cover 33. The cover 33 would be adapted to engage with the exterior of the device 10 in the area of the housing 11 to allow for insertion of the container 29 into the cavity 26.

The container 29 would be held in the cavity 26 by its engagement to the cover 33 and the cover's engagement to the housing 11. The cover 33 or other component of the container 29 may additionally employ a twist-and-lock feature for engagement to the housing 11 providing added securement of the container 29 within the cavity 26 and the ability to rotate the container 29 to position the container 29 properly to accommodate the downward mounting angle of the housing 11 in its engagement to the conventional toilet tissue mount in a bathroom which may be recessed or projecting from the wall adjacent to the toilet. User's having a projecting conventional mount, may rotate the handle 49 to rotate the container 29 and align the axis of the handle 49 substantially parallel to the floor of the room from the substantially a 90 degree angle "A" in FIG. 12.

The engagement between the container 29 and the cavity 26 has a plurality of cooperative registration components such as notches 51 removably engaging a cooperating projection 53. This provides a means for adjustable registration so users having right sided or left sided recessed conventional mounts, may rotate the container by using the handle 49 to cause a rotation of the container 29 in either of both directions. The plurality of angles can be numerous and in substantially equal increments.

Currently at least two additional notches 51 positioned to allow an angle change of the handle axis or of the aperture 35 of +−15 degrees (a1 and a2 of FIG. 12) is particularly preferred. The notches 51 may be placed on opposing sides to allow for mounting the aperture 35 in rooms where the device 10 is to the right or the user, or the left of the user. This 15 degree offset from has been found to offset the cover 33 to maintain an attractive angle of the handle 49 to the floor. However just as important is the proper positioning of the aperture 35 to allow for easy dispensing of the towelettes 31. Thus the plurality of cooperative registration components can include more than three and allow the user to rotate the engagement of the container 29 as a means to position the aperture 35 to any of a plurality of removably fixed positions. This customization is provided as a great utility to accommodate the user's personal preference during reaching for towelettes 31 which is greatly dictated by the user's stature and reach.

The removable mode of mounting replaceable containers 29 sold to engage the cover 33 which is configured to engage the housing 11 is particularly preferred if the device 10 sold as a unit of housing 11 and engageable cover 33 with one or a plurality of containers 29 of towelettes 31 which would be replaceable as they run out. In that fashion the provider of the device 10 and the user, would be assured of a supply of replacement containers 29 of towelettes which will engage operatively with the device 10 such as from the super market. Further, if the towelettes 31 were prescription or employed for some special hygienic reason, it will allow for the containers 29 to be sold by pharmacies with the specialized towelettes 31 and insure a constant, renewable, handy supply and insure that the user cannot engage a conventional retail towelette container by mistake.

Figure 13:
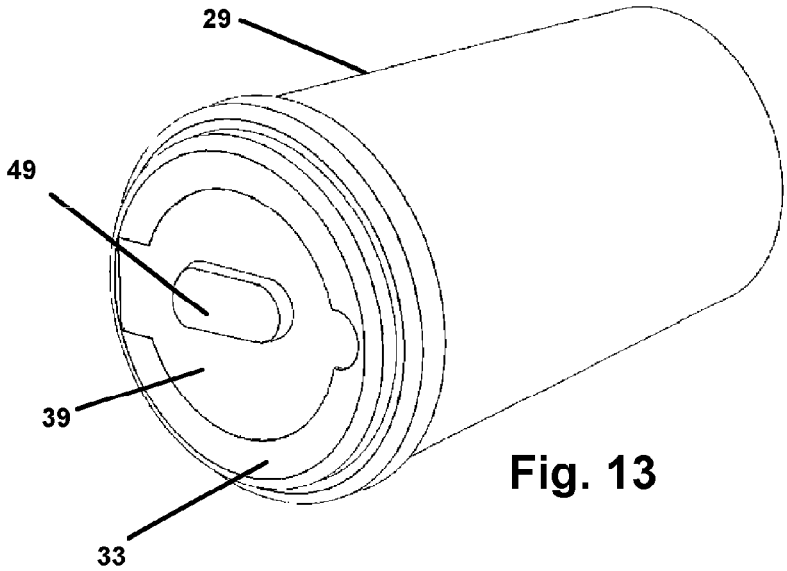
FIG. 13 depicts a mode of the device using replaceable towelette containers which employ a handle to mount and position the aperture.
Figure 14:
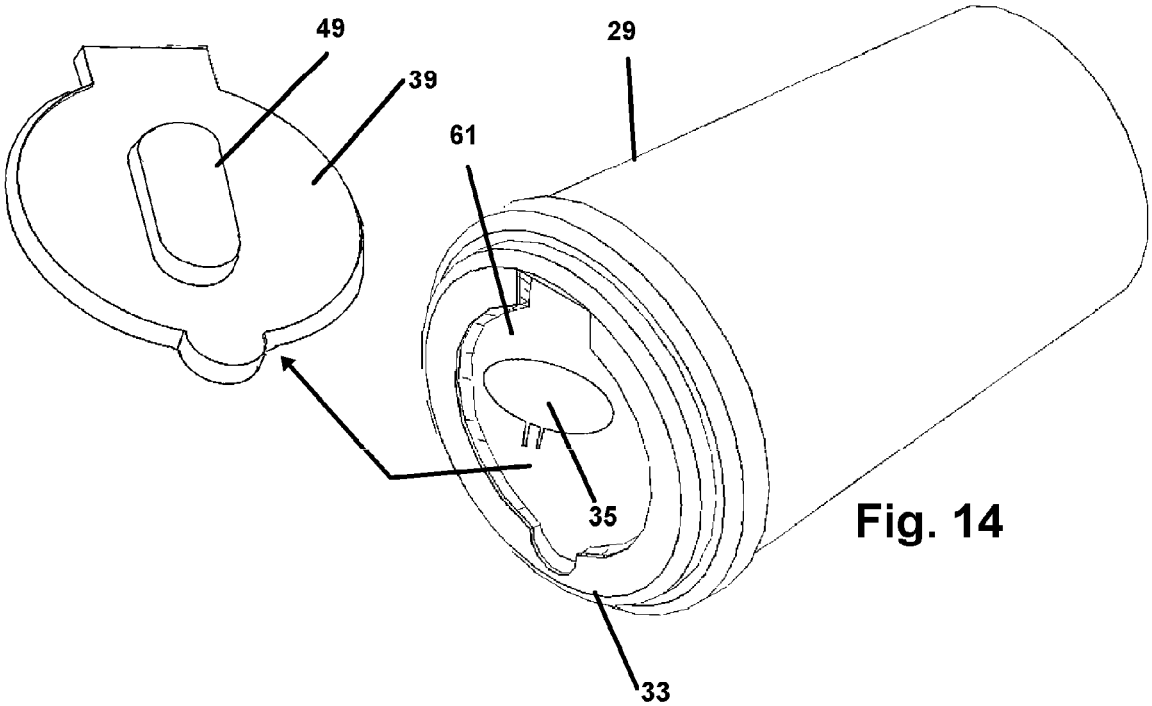
FIG. 14 shows the container of FIG. 13 with the handle disengaged.

A particularly preferred mode of configuration of such a removable container 29 is shown in FIGS. 13 and 14. This mode of the device 10 features containers 29 which may be sold as replacements for engagement in the cavity 26. The container 29 has a removable cap 39 which has a perimeter shape configured to engage within a complimentary-shaped recess 61. The handle 49 positioned on the removable cap 39 provides the user a means to dismount the engaged cap 39 from its engagement within the recess 61 once the container 29 is properly positioned within the cavity 26.

Mounting the container 29 into the housing 11 is accomplished by using a hand to engage the handle 49 which is positioned in the recess 61, and then rotating the container 29 while it is inserted into the cavity 26. This rotation provides a means for employing the cooperative removable engagement of the container 29 in the cavity 26 and thus to the housing 11. The removable cap 39 can then be disengaged from the recess 61 to render the aperture 35 viewable.

If the container 29 and housing have registration components, the handle 49 may be employed to continually insert and remove the cap 39 in the recess 61 and then used to rotate the container 29 to properly position within the aperture 35 for aesthetics or the user's use-preference. This preference may be dictated by their height and arm length and ability to reach when using the device. The containers 29 may be sold with or without the removable cap 39 and handle 49, but they should be sealed to maintain the towelettes inside moist and clean.

In a particularly preferred mode of the device 10, an air freshener 30 component can be provided, which is adapted for engagement with the exterior of the housing 11 or the planar members 12 or the container 29. The addition to scents in bathrooms and the like is preferred in many households and businesses. With this component, the device 10 would provide a recess 43 formed in either the housing 11 as shown, or it might be formed in one of the planar members 12 or it may be an elongated aperture type recess 43 formed to align with the freshener 30 positioned upon a container 29. If formed in the bottom of the housing 11 as shown in FIG. 6, the air freshener 30 would provide a pleasant scent to the room in which the device is placed, but would also be out of sight and could also be formed to allow communication of scent from an air freshener 30 engaged with a container 29 as in FIG. 16, to allow easy concurrent replacement of the air freshener 30 with replacement of each container 29.

As shown in FIG. 6, in a preferred mode of the device 10 which would allow for convenient replacement of the air freshener 30 component, the air freshener 30 component is adapted for a slide-in engagement with a recess 43 or second cavity of the device 10 through an aperture 44. The recess 43 engaging the air freshener 30 may be adapted to engage with commercially available air freshener containers or one that is designed for engagement with the device 10 wherein refills would be made available. An opening on a side of the recess 43 provides a means for the scent impregnated to the air freshener 30 component to escape and improve the odor in the room in which the device is located.

Figure 7:
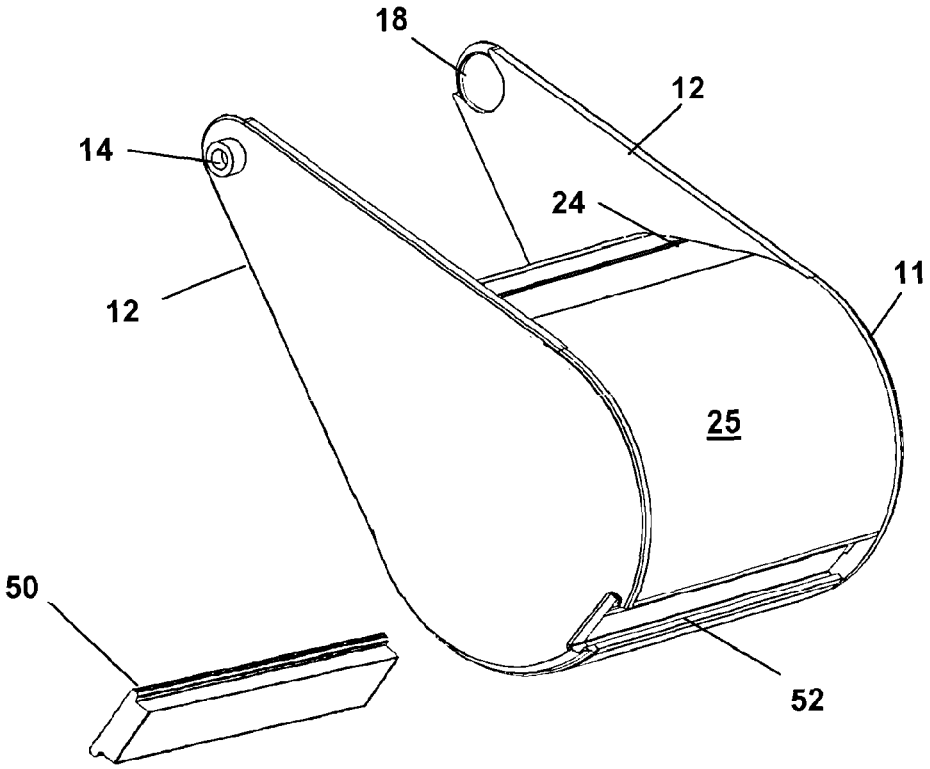
FIG. 7 shows a bottom perspective view of the device configured with a slot and a tab as a means for a mounting or positioning of the device to a surface such as a wall or cabinet, countertop, floor, or another fixture.

Referring now to FIG. 7, there is shown still another preferred mode of the device 10 in which a mount tab 50 is provided for engagement to a surface such as a wall, floor, countertop, or under a cabinet. The tab 50 can be engaged to the mounting surface so as to allow either a vertical, horizontal or sideways positioning. As depicted, the tab 50 can engaged to a mounting surface such as a wall (not shown) or similar fixture within the bathroom, or elsewhere in a home or building, preferably at or near the place of employment, by any engagement means known in the art such as screws, bolts, or adhesives for example. With this component, the device 10 would similarly provide a slot recess 52 formed in either the housing 11 as shown, or alternatively it might be formed in one of the planar members 12. The slot 52 is intended to removably engage and receive the tab 50 for mounting purposes and may differ from the recess 43 of the air freshener mode of FIG. 6 in that the slot 52 now must bear the weight of the device 10. The device 10 in the as used mounted mode (not shown) would be positioned such that the distal ends of the member 12 extended horizontally outward.

The provision of the tab 50 and slot 52 mounting means allows a user to employ the device 10 at any location within a home or building and in the case of a bathroom, without the limitation of the location of the conventional toilet paper mount. Further, the removable engagement of the device 10 with the tab 50 allows the user to remove the device 10 from a mounted position to aid in refilling the containers 29 as needed.

Figure 8:
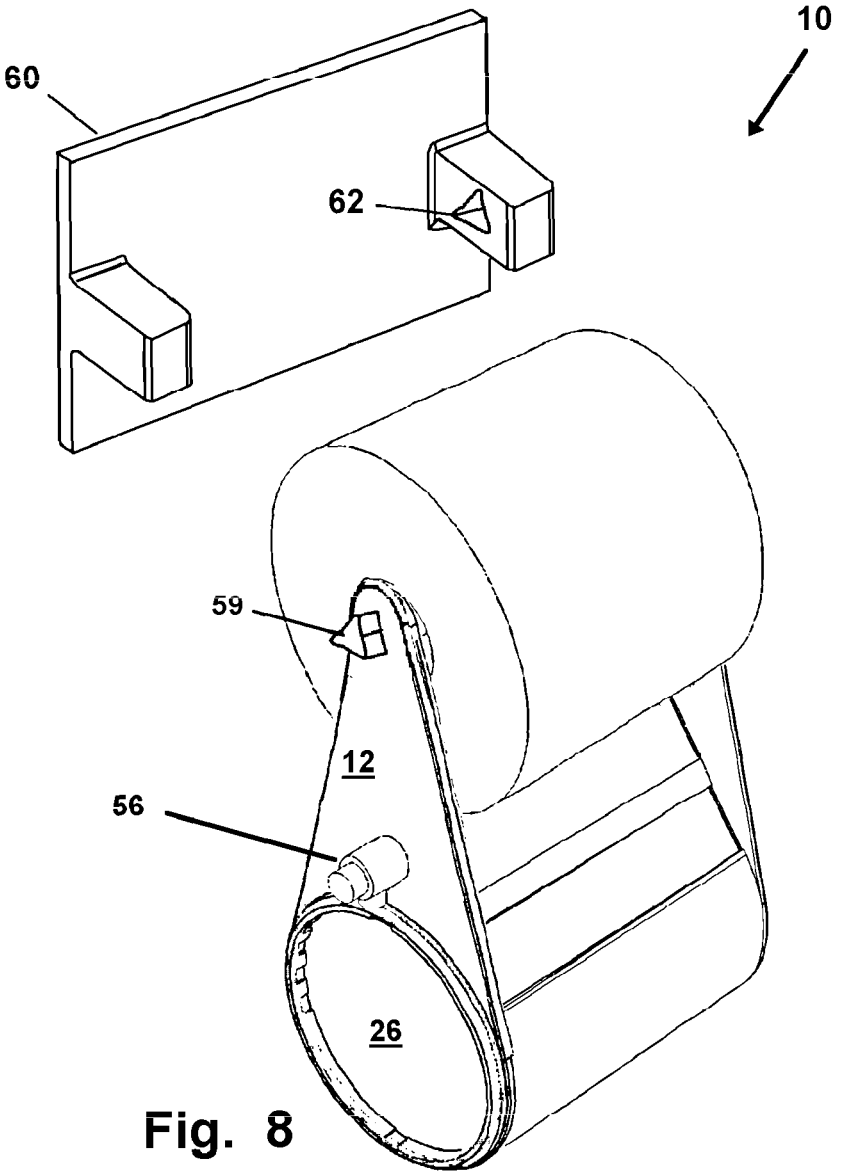
FIG. 8 is a side perspective view of the device showing a hand sanitizer reservoir engaged upon an upper surface of the sidewall surrounding the towelette container cavity with dispenser projecting from a planar member.

As in FIG. 8, the device 10 is shown in yet another particularly preferred mode with a liquid reservoir 54 located in gap 21 between the planar members 12. The reservoir 54 can be permanently engaged or otherwise formed unitarily. One planar member 12 includes a pump component 56 providing means to dispense hand sanitizers solution or the like as desired. However in another mode the reservoir may be removably engaged through the member 12 such as by biasing clips (not show) or other removable engagement means known in the art. Additionally the reservoir 54 may be employed with any existing hand sanitizers container known in the art which can be removably engaged by the aforementioned biasing clips or other means. Alternatively, the reservoir 54 may be engaged to the planar member 12 such as to allow the pump 56 to be repositioned upright should the device 10 employ the mounting means shown previously in FIG. 7.

Additionally shown in FIG. 8, the device 10 is equipped with another preferred means to mount the device 10. This is depicted as the a mount 60 similar to the conventional toilet paper mount mentioned previously. However to engage the device 10 with the mount 60, the pair of projecting opposing planar members 12, each have opposing cooperative exterior projections 59, positioned on the members 12 in a manner intended to engage the cooperatively shaped recesses 62 of the mount 60.

The depicted cooperatively engageable shapes of the recesses 62 and exterior projections 59, as can be discerned from the figure, provide a means to prevent rotation of the device 10 when in the mounted as-used mode. In this mode the supplier of the device 10 will similarly supply the particular mount 60 as package and may be preferred over other modes due to the added securement of the device 10 to the mount provided by the cooperative recesses 62 and complimentary shaped protrusions 59.

Figure 9:
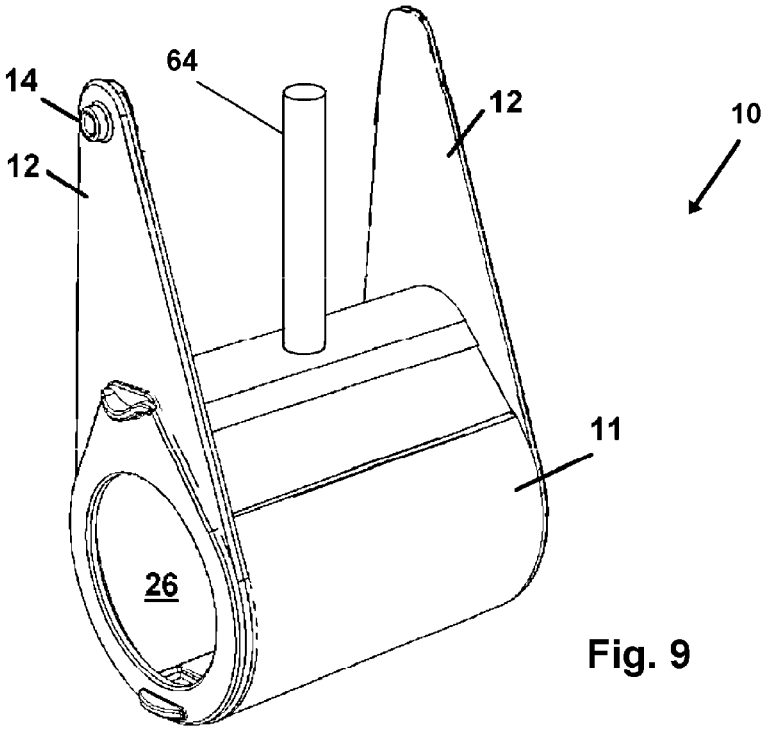
FIG. 9 shows yet another mode of the device employing a vertically disposed elongated member for receiving a toilet paper roll.

As is FIG. 9, there is shown a still further particularly preferred mode of the device 10 wherein the housing 11 employs an elongated member 64 adapted to receive a vertically disposed toilet paper roll (not shown). In this mode the opposing recesses 18 or opposing projections 58 employed previously to engage the telescoping member 16 or toilet paper, respectively, are omitted as now a user will simply place the toilet roll directly over the elongated member 64 as needed.

It is within the scope of the invention to provide towelette dispensing means in other locations in the home aside from the bathroom, such as in the kitchen. As such, depicted in FIG. 10, the device 10 includes a substantially elongated housing 13 such as to provide a substantial gap 23 defined by the area between the planar members 12 and is adapted to engage a conventionally larger paper towel roll (not shown).

Figure 10:
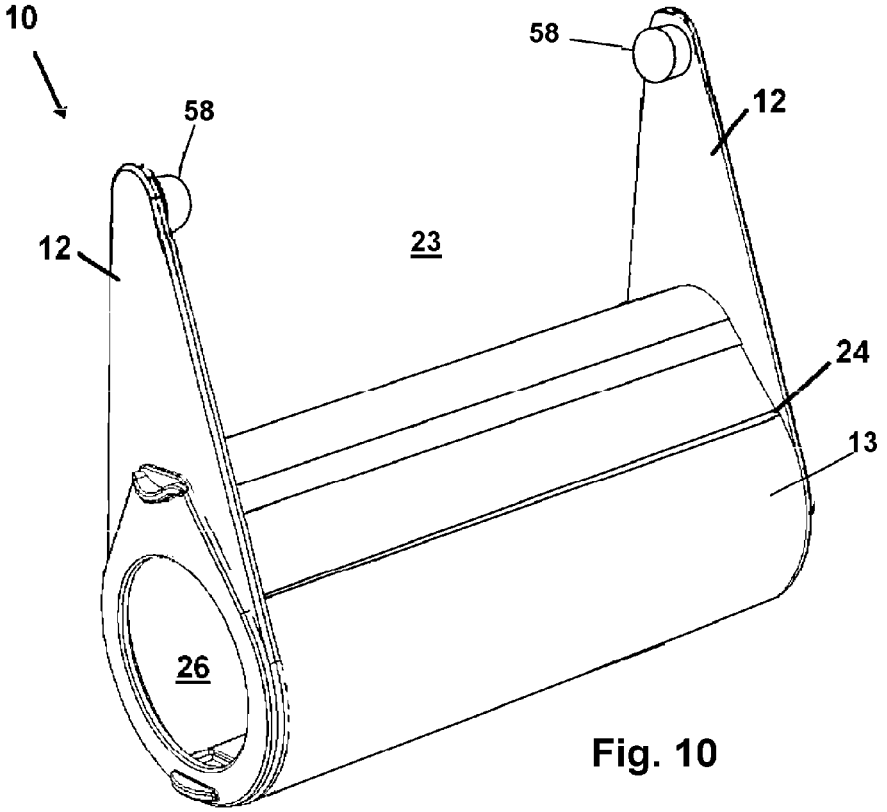
FIG. 10 displays a mode of the device adapted for receiving paper towel rolls and employable for dispensing paper towels.

Another means for engaging a toilet paper roll to the device 10 can be seen in FIG. 10. As shown, the opposite side of the distal ends of the projecting planar members 12 from the projections 14 are positioned additional opposing projections 58. These additional projections 58 are adapted to engage directly to the toilet paper tube of a conventional toilet paper roll which provides added utility by eliminating the need for the conventional telescopic member 16.

The roll will be allowed to spin on the axis provided by opposing projecting members 58 and thereby dispense sheets of paper towels. As can be seen in the figure, guide slots 24 may similarly be provided as a means to direct the paper towel during use. Once again, placement of the guide slots 24 on both sides of the housing 13 allow for their use in either a right handed or left handed mount, which depends upon placement of the device 10 within a kitchen or other area.

Further, the elongated housing 13 will allow for operative engagement with larger towelette containers 29, as are often seen in kitchenware. This is opposed to the often smaller bathroom style towelettes and containers shown previously. It must be noted that this mode as well as all other modes of the device 10 disclosed may be used separately or in combination with other preferred modes of the device 10 and should not be considered limiting by the depictions. A towelette container 29 would be fitted within the cavity 26 and may have sanitizers or cleaning solution operatively imparted to the towelettes.

Figure 11:
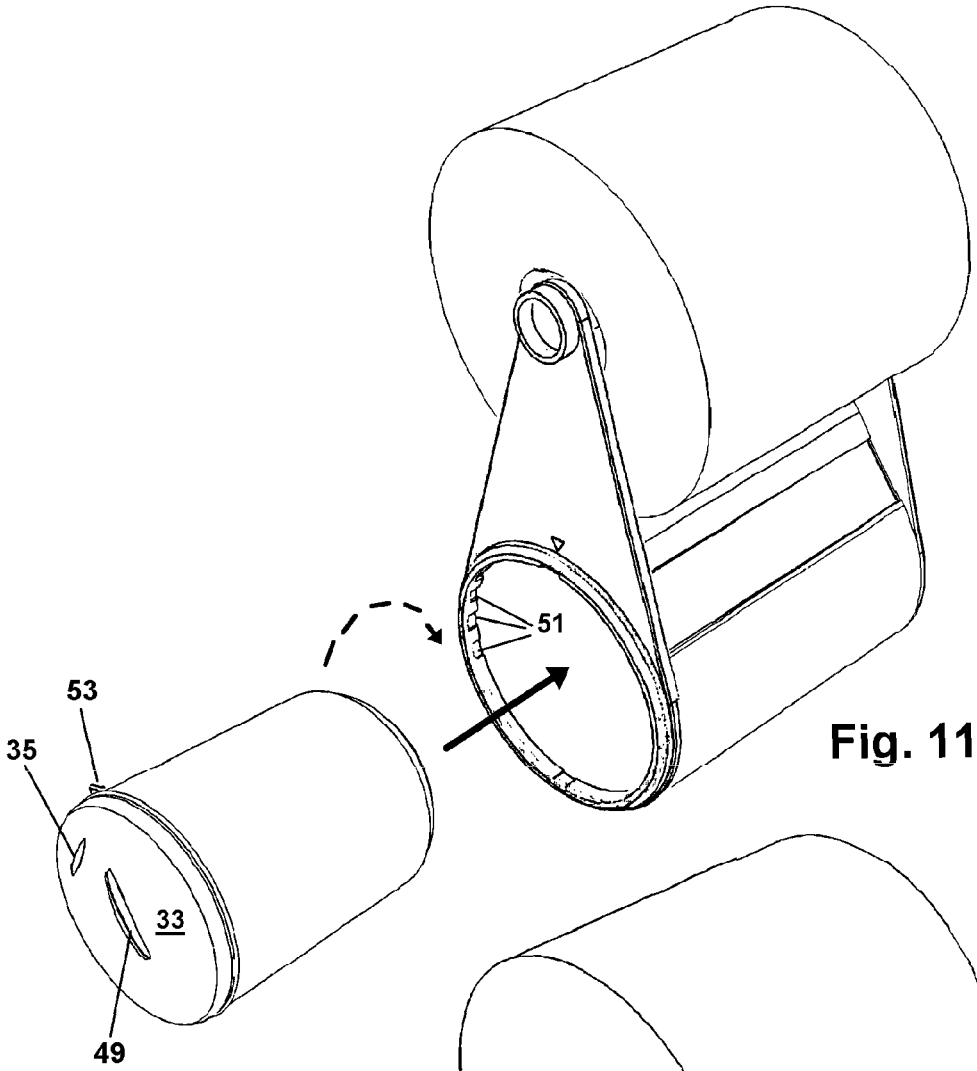
FIG. 11 depicts a mode of the device employing a rotatable container which is removably engageable and can be rotated to properly position the towelette aperture for easy reach.

In FIG. 11 there is shown a mode of the device 10 employing a rotatable container 29 which is removably engageable within the cavity 26. As noted above, the cover 33 may additionally employ a twist-and-lock feature for engagement to the housing 11 providing added securement of the container 29 within the cavity 26 and the ability to rotate the container 29 to various positions as a means to adjust the position of the aperture 35 to accommodate the downward mounting angle of the housing 11 in its engagement to the conventional toilet tissue mount in a bathroom. Such conventional mounts may be recessed or projecting from the wall adjacent to the toilet and may be at differing recessed or projecting positions.

Figure 12:
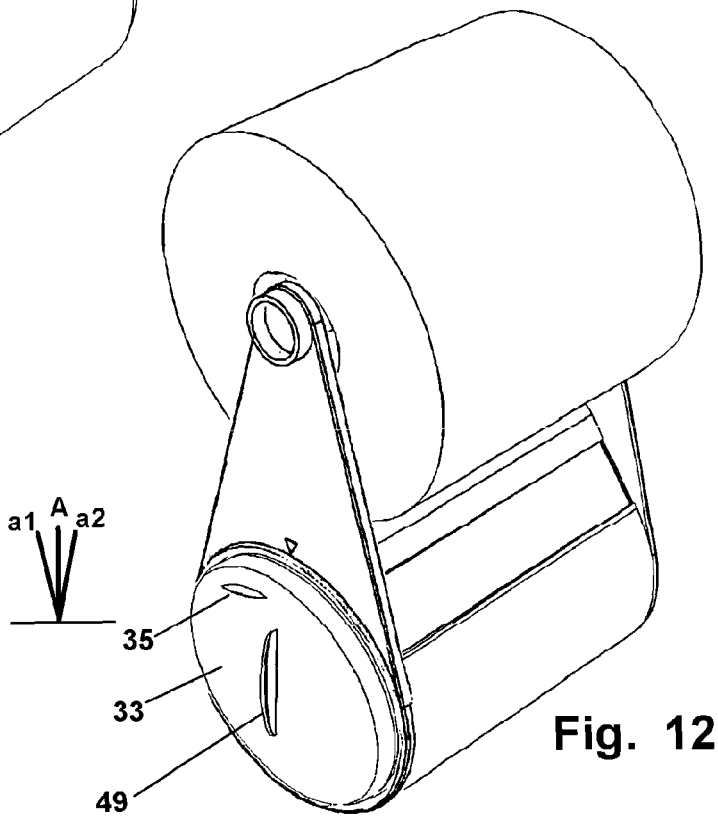
FIG. 12 depicts the device of FIG. 11 with the towelette container engaged in the container cavity.

The device of FIG. 11-12 allows a user having a projecting conventional mount, to rotate a handle 49 to align its axis from a position substantially perpendicular to the floor of the room at substantially a 90 degree angle "A" in FIG. 12 as far as a position substantially parallel to the floor of the room. Anywhere the user decides along this rotation which will provide them with proper positioning of the aperture 35 for most cases may be chosen. This is most important where the mount is on the left side or right side of the user since the aperture 35 needs to be easily reached.

The engagement between the container 29 and the cavity 26 in FIG. 11-12, provides the plurality of cooperative registration components such as notches 51 removably engaging a cooperating projection 53. This rotatable registered engagement to positions provides users having right sided or left sided recessed conventional mounts, a means to adjust the angle of the handle 49 to cause a rotation of the cover 33 both directions and move the aperture slightly to accommodate their personal preference. The plurality of angles can be numerous and in substantially equal increments.

As noted above, at least two additional notches 51 positioned to allow an angle change of the handle axis or of the aperture 35 of +−15 degrees shown as a1 and a2, is particularly preferred. This 15 degree offset has been found to offset the cover 33 to maintain a more attractive angle of the handle 49. However just as important is the proper positioning of the aperture 35 to allow for easy dispensing of the towelettes 31. As noted above, the plurality of cooperative registration components can exceed three and allow the user to rotate the engagement of the container 29 as a means to position the aperture 35 to any of a plurality of removably fixed positions to accommodate the user's personal preference during reaching for towelettes 31.

As noted above, there is depicted in FIGS. 13 and 14, a particularly preferred mode of configuration of the removable container 29. The handle 49 positioned on the cap 39 in this mode is employed as a means to rotate and engage the container 29, which may be sold as replacements or in kits of replacements. The containers 29 have a recess 61 which is cooperatively removably engageable with the handle 49. Once the container is rotated to the desired position the cap 39 is then removed and the aperture 35 viewable. Employed with registration components, the cap 39 with handle 49 may be consecutively inserted and removed to allow rotation of the container 29 to properly position the aperture 35.

Figure 15:
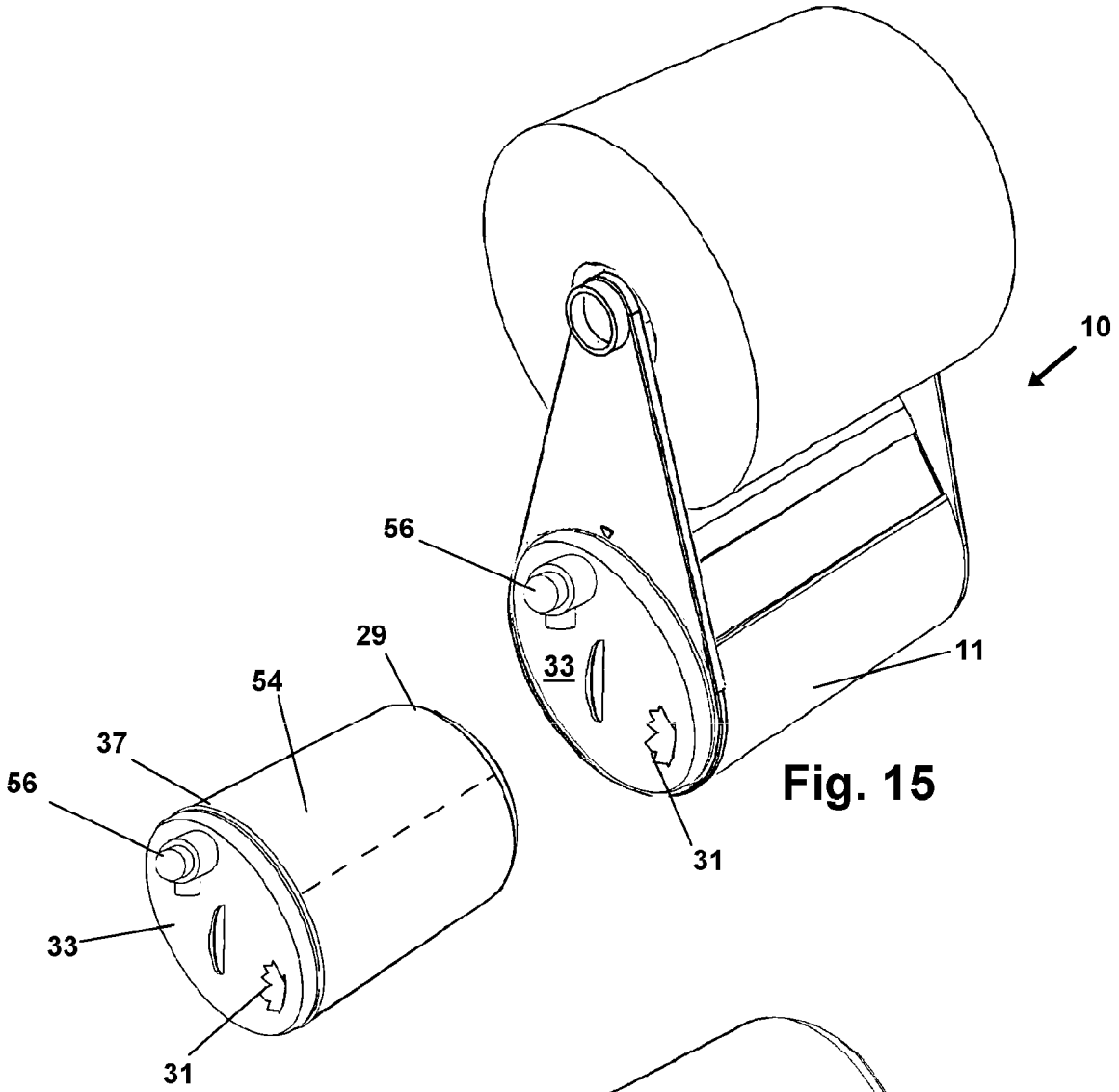
FIG. 15 depicts a mode of the device having reservoir of hand sanitizers solution formed within a portion of the container and a dispenser operatively engaged thereto.

FIG. 15 depicts a mode of the device 10 employing a housing having reservoir 54 of hand sanitizers solution formed within a portion of the container 29 and a dispenser 56 operatively engaged thereto. Rotational registration as described would be preferable to allow the user to properly position the dispenser 56 and place the handle 49 vertical depending on the angle of the device 10 descending from its engagement to a conventional mount. Projections 14 allow for engagement with the conventional mount while opposing projections 58 allow for engagement of the toilet paper thereon.

Figure 16:
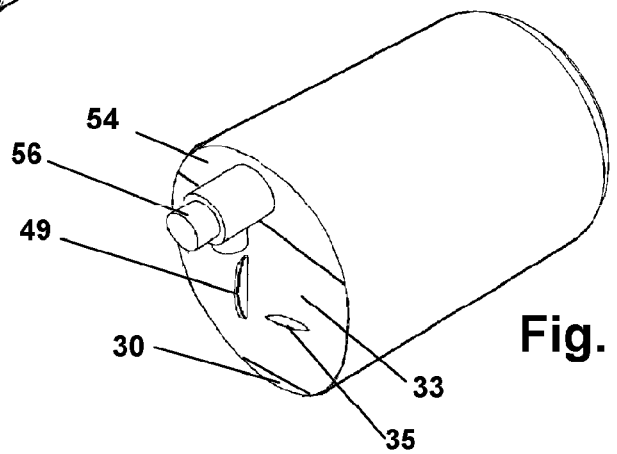
FIG. 16 depicts a particularly preferred mode of the device which employs a towelette container which also provides a reservoir of sanitizers solution with operative dispenser and deodorizer.

FIG. 16 depicts a particularly preferred mode of the device 10 which employs a towelette container 29 allowing for concurrent replacement of the reservoir 54 and hand sanitizers along with the towelettes 31 and the deodorizer 30. Rotational means of registration of the container 29 with the housing 11 is desirable with this mode to properly position the aperture 35 and the dispenser 56 for proper operation.

Figure 17:
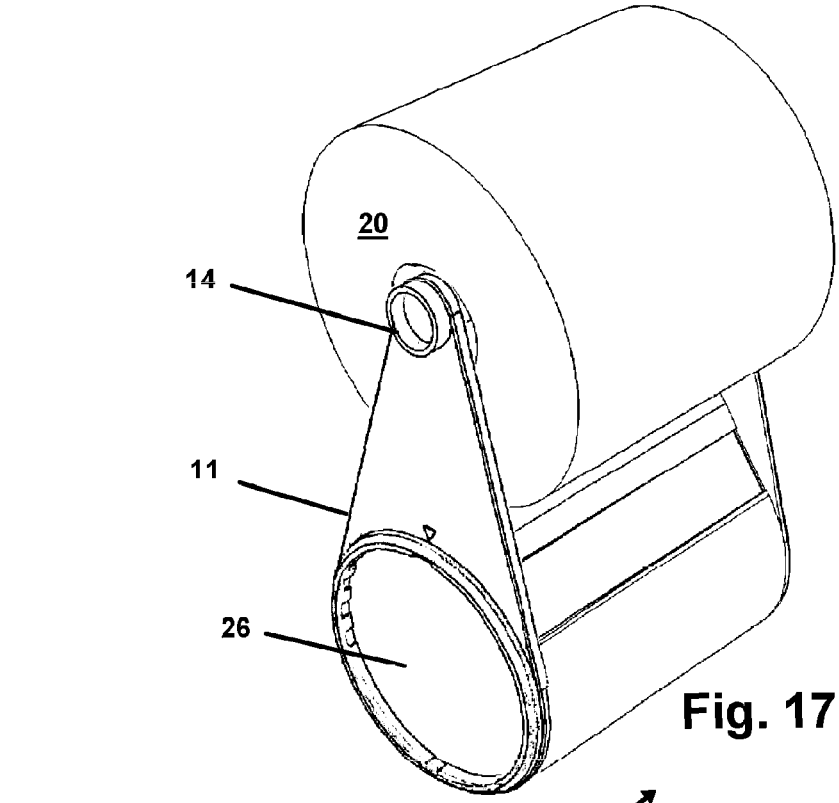
FIG. 17 shows a mode of the device wherein the reservoir is engageable with a lower portion of the sidewall forming the towelette container cavity.

FIG. 17 shows a mode of the device wherein the reservoir 54 is removably engageable with a lower portion of the housing 11 on the wall forming the towelette container cavity 26. Removable engagement such a depicted cooperating fasteners, or adhesive, or other cooperative fasteners adapted to the task may be employed.

Figure 18:
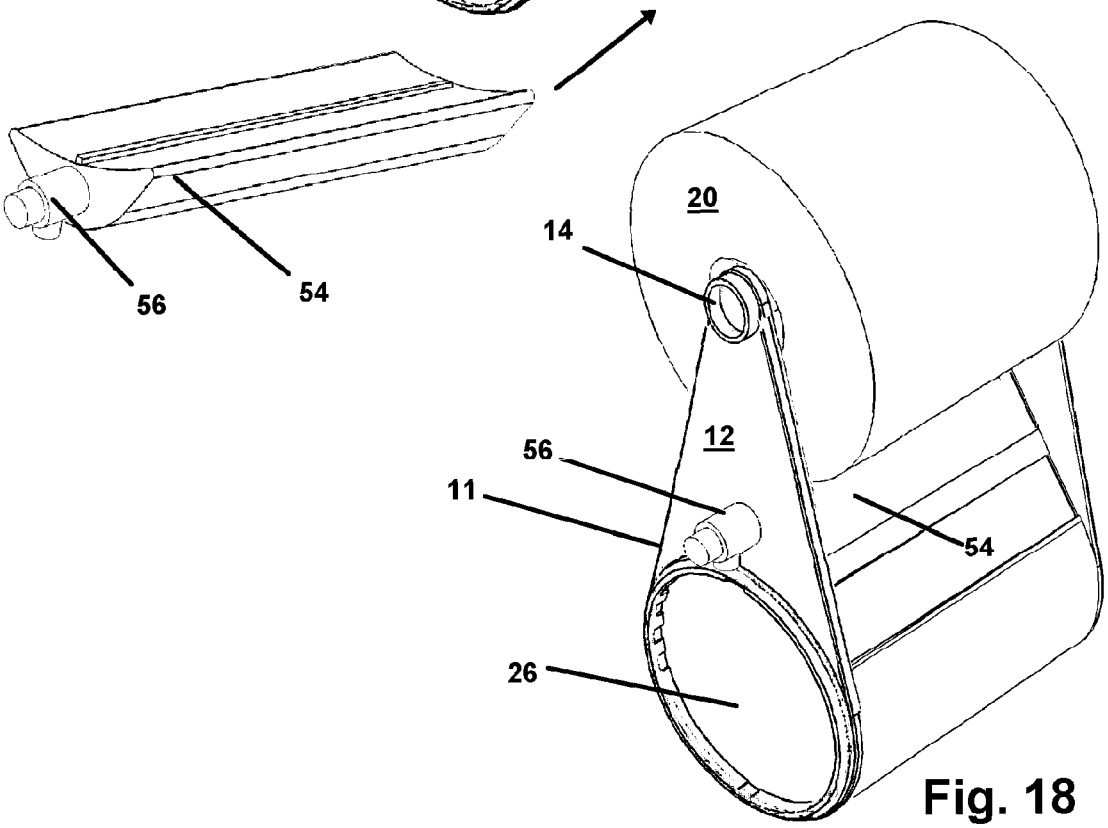
FIG. 18 depicts the device having the reservoir engaged to an opposite wall forming the container cavity from FIG. 17.

FIG. 18 depicts the device 10 having the reservoir 54 engaged to an opposite wall forming the container cavity 26 from that of FIG. 17. This may be permanent with the dispenser 56 engaged through the sidewall, or removably engaged by allowing removal of the dispenser 56 from the reservoir and sidewall and removal of the reservoir 54 for refilling.

While the present invention has been described herein with reference to particular embodiments thereof, a latitude of modifications, various changes and substitutions are intended in the foregoing disclosure, and it will be appreciated that in some instance, some features of the invention could be employed without a corresponding use of other features without departing from the scope of the invention as set forth in the following claims. All such changes, alternations and modifications, as would occur to those skilled in the art, are considered to be within the scope of this invention as broadly defined in the appended claims.

What is claimed is:

1. A moist towelette dispenser apparatus adapted for engagement with a toilet paper dispensing assembly having an elongated cylindrical spindle having two ends which are engageable with spindle mounts on a tissue paper fixture, for supporting a roll of toilet paper surrounding the spindle, said apparatus comprising:

a housing;

a first member extending from said housing to a first distal end;

a second member extending from said housing to a second distal end;

a gap formed between a first side surface of said first member and an opposing first side surface of said second member;

engagement points for said two ends of said spindle, a first of said engagement points positioned upon said first side of said first member and a second of said engagement points positioned on said first side surface of said second member;

said engagement points adapted for operative engagement of said spindle therebetween to an engaged position, extending between said first member and said second member;

mounts positioned on respective second side surfaces of said first member and said second member, said respective second side surfaces of said first and second members being opposite respective said first side surfaces of said first and second members, said mounts adapted for operative engagement with said spindle mounts on said toilet paper fixture;

said housing having a cavity defined by a sidewall surrounding an axis of said cavity, said sidewall extending between a first end of said housing connected to said first member and a second end of said housing connected to said second member;

said cavity sized to accommodate a container surrounding a supply of moist towelettes therein, said container in a removable engagement with said cavity;

said container having an exterior surface defining an exterior shape which is complimentary to an interior shape of said cavity;

an aperture positioned in a first endwall of said container;

at least one notch formed on an interior surface of said sidewall defining said cavity;

a projection extending from said exterior surface of said container;

said container translatable into said cavity through said first end of said housing in a direction toward said second end of said housing to an aligned position to thereby position said aperture in said first endwall of said container, at said first end of said housing;

said container in said aligned position rotatable to engage said projection in said notch;

said aperture defining a dispensing passage for individual said towelettes therethrough from said from said supply positioned within said cavity, whereby said towelettes are individually dispensible from said supply, by a pulling thereof through said aperture, in a direction along or parallel to said axis of said cavity, and away from said second surface of said first member and said container may be replaced with a new said container of said towelettes to replenish a supply of said towelettes.

2. The moist towelette dispenser apparatus of claim 1 wherein said removable engagement additionally comprises:

a plurality of said notches formed along a radial line extending around said interior surface of said sidewall defining said cavity; and said container in said aligned position rotatable to engage said projection with any of said plurality of notches to thereby register said aperture in a position at said first end of said housing.

3. The moist towelette dispenser apparatus of claim 1 additionally comprising:

a lid in a hinged engagement to said first endwall of said container and configured to move between a first position covering said aperture, to a second position uncovering said aperture.

4. The moist towelette dispenser apparatus of claim 1 additionally comprising:

a lid in a hinged engagement to said first endwall of said container and configured to move between a first position covering said aperture, to a second position uncovering said aperture.

5. The moist towelette dispenser apparatus of claim 2 additionally comprising:

a lid in a hinged engagement to said first endwall of said container and configured to move between a first position covering said aperture, to a second position uncovering said aperture.

6. The moist towelette dispenser apparatus of claim 4 additionally comprising:

a handle extending from an exterior surface of said lid; and said handle configured imparting a twisting force thereon with the hand of a user to rotate said container while in said aligned position to engage said projection in said notch.

7. The moist towelette dispenser apparatus of claim 4 additionally comprising:

an elongated handle extending from an exterior surface of said lid;

said handle extending along a line parallel with a plane of an elongated aperture covered by said lid; and said handle configured imparting a twisting force thereon with the hand of a user to rotate said container while in said aligned position to engage said projection in said notch.

8. The moist towelette dispenser apparatus of claim 5 additionally comprising:

an elongated handle extending from an exterior surface of said lid;

said handle extending along a line parallel with a plane of an elongated aperture when covered by said lid; and said handle configured imparting a twisting force thereon with the hand of a user to thereby rotate said container while in said aligned position to an engagement said projection with one of said plurality of notches, whereby said user can rotate said container to align said elongated aperture along an angle relative to a level floor desired by said user for pulling said towelettes therethrough.

9. The moist towelette dispenser apparatus of claim 8 additionally comprising:

said plurality of notches being radially positioned to achieve a said angle between −15 degrees and +15 degrees relative to a level floor surface below said dispenser.

10. The moist towelette dispenser apparatus of claim 1 additionally comprising:

a rotation of said container from said aligned position to engage said projection in said notch, forming a lock of said container within said cavity thereby preventing removal therefrom.

11. The moist towelette dispenser apparatus of claim 4 additionally comprising:

a rotation of said container from said aligned position to engage said projection in said notch, forming a lock of said container within said cavity thereby preventing removal therefrom.

12. The moist towelette dispenser apparatus of claim 7 additionally comprising:

a rotation of said container from said aligned position to engage said projection in said notch, forming a lock of said container within said cavity thereby preventing removal therefrom.

* * * * *